United States Patent [19]

Warnecke

[11] 4,393,606

[45] Jul. 19, 1983

[54] EXCAVATOR WITH LASER POSITION INDICATOR

[75] Inventor: Waldemar Warnecke, Grasleben, Fed. Rep. of Germany

[73] Assignee: Friedrich Wilh. Schwing GmbH, Herne, Fed. Rep. of Germany

[21] Appl. No.: 296,450

[22] Filed: Aug. 26, 1981

[30] Foreign Application Priority Data

Aug. 30, 1980 [DE] Fed. Rep. of Germany ..... 3032821

[51] Int. Cl.[3] ..... E02F 5/02

[52] U.S. Cl. ..... 37/103; 37/DIG. 19; 414/694; 172/430

[58] Field of Search ..... 37/103, DIG. 19, DIG. 20, 37/DIG. 1; 172/4, 4.5, 430; 414/694,695, 698, 699; 356/153, 154; 33/185 V, 286, 290, 293, DIG. 21

[56] References Cited

U.S. PATENT DOCUMENTS

| | | | |
|---|---|---|---|
| 3,003,651 | 10/1961 | Holopainen | 37/103 X |
| 3,426,146 | 2/1969 | Seaman | 172/4.5 X |
| 3,586,182 | 6/1971 | Schwing | 214/138 |
| 3,588,255 | 6/1971 | Alexander | 33/290 X |
| 3,656,640 | 4/1972 | Schwing | 214/138 |
| 4,231,700 | 11/1980 | Studebaker | 37/DIG. 1 |
| 4,273,196 | 6/1981 | Etsusaki et al. | 37/DIG. 20 |
| 4,277,899 | 7/1981 | Gufhoff | 37/103 |

FOREIGN PATENT DOCUMENTS

| | | |
|---|---|---|
| 1800045 | 4/1968 | Fed. Rep. of Germany . |
| 1912614 | 10/1970 | Fed. Rep. of Germany . |
| 1513746 | 1/1968 | France . |
| 2323124 | 9/1975 | France . |
| 1112103 | 5/1968 | United Kingdom . |

OTHER PUBLICATIONS

*Laser Instruments for Engineering Construcion,* Spectra-Physics, Sep. 19, 1967.

*Primary Examiner*—Edgar S. Burr
*Assistant Examiner*—David A. Wiecking
*Attorney, Agent, or Firm*—Kinney, Lange, Braddock, Westman & Fairbairn

[57] ABSTRACT

A trench hoe-type excavator carries a digging bucket at the end of a digging device. The bucket and digging device are capable of being driven so as to maintain a set cutting angle. An indicating apparatus arranged in the field of view of the excavator operator allows the operator to check the position of the digging device to determine the direction in which the bucket must be guided in order to obtain the desired inclination and direction of the ditch floor. The indicator apparatus includes a laser transmitter and a transparent target. The transparent target is carried by the digging device and has a first surface facing the bucket operator and a second surface which is arranged to receive the laser beam from the laser transmitter. The laser transmitter is arranged on the opposite side of the target from the excavator operator, so that the position of the end point of the laser beam on the target can be observed, parallax-free, by the excavator operator during the entire digging operation.

5 Claims, 3 Drawing Figures

EXCAVATOR WITH LASER POSITION INDICATOR

BACKGROUND OF THE INVENTION

1. Field of the Invention

The present invention concerns a bucket excavator such as a trench hoe with an arrangement for checking the position of its digging device relative to a digging floor.

The invention is particularly applicable to an excavator which carries a deep digging bucket or dipper on its digging device, whose cutting edge corresponds at least to a part of the cross-sectional line of a ditch, so that half-round digging or ditch floors can be produced with such an excavator in one or more operations. Preferably such an excavator is provided with a parallel guidance of its bucket, which once the cutting angle is set, guides the bucket substantially over the entire prospecting range during the digging movement (e.g. along an embankment or an inclined or plane ditch floor) without any special intervention by the bucket operator.

2. Description of the Prior Art

Such excavators already belong to the state-of-the-art (German Pat. No. 1,800,045 and U.S. Pat. Nos. 3,586,182 and 3,656,640). In principle, they are so designed that the hydraulic cylinder for turning the bucket engages, on the one hand, the boom close to the pivot of the dipper arm and, on the other hand, a triangular shift lever secured in the dipper arm next to the pivot of the bucket, and that the shift lever is so connected with the bucket over a short guide rod that the bucket arm, the shift lever, and the hydraulic cylinder together with the front end of the boom form a large four-bar linkage, which is coupled over a shift triangle, formed of the triangular shift lever, with a small four-bar linkage formed of the shift lever, the end of the bucket arm, the bucket and the short guide rod, and that with a given length of the dipper arm and a given length of the boom, the dimensions of the four-bar linkages as well as of the shift triangle are so tuned to each other, and that the large four-bar linkage is so varied by means of the hydraulic cylinder when adjusting the cutting angle of the bucket to the inclination of a slope to be worked on and thus adapted to the inclination of the slope, that the bucket is guided parallel substantially over the entire swing of the bucket during the digging movement, taking into account the swinging movement of the boom corresponding to the inclination of the slope. This has the advantage that the preselected cutting angle is positively maintained, so that the excavator operator only has to actuate the digging movement with a hydraulic cylinder on the digging device of the excavator.

The invention is based on a known excavator of this type, which is provided additionally with a device for indicating the position of its bucket. In the known excavators, a pointer is used which follows a guide rod representing a connection between the swivel hinge of the bucket and an parallel axis base-swivel joint on the pivotal substructure of the excavator. The position indicator can be corrected for inclined positions of the excavator in the guide rod plane on the pointer scale and for different distances of the excavator from the working plane by vertical adjustment of the parallel axis swivel joint on the superstructure of the excavator. Such an arrangement has the following advantage: when the excavator rests, for example, on the crest of a bank, and the slope is to be reworked with a given angle of inclination, the excavator operator only has to change the cutting angle on a part of the slope until the pointer bears on the given slope angle. The excavator operator can then drive the slope from the selected location of the excavator without visual control of the digging device or of the bucket, and correct the cutting angle, if necessary, according to the indication. Such an arrangement ensures the driving of the plane or weakly inclined digging level, but is not suitable for certain specific cases.

For example, this prior art arrangement is unsatisfactory for the driving up of ditch floors with exact maintenance of the given contour of the ditch. This is required in the laying of large pipes of steel concrete, because the ditch floor must be driven corresponding to the curvature of the pipes and corresponding to the gradient of the line consisting of the pipes in order to avoid correction of the pipes. In order to facilitate understanding, the invention will hereinafter be described by the example of such excavating operations. If a excavator is to drive such ditches, it must be driven relatively frequently in a previously dug outer ditch. Since the known arrangement uses the standing plane of the excavator as a reference plane, while the excavator changes its standing plane before and after the driving, it would be necessary in such operations to readjust the measuring arrangement after each driving of the excavator.

It is also known to use laser systems for the optical reproduction of the vertical and horizontal aspects on construction sites. This possibility is based on the sharp focusing of the laser light which is emitted from a suitable transmitter and which forms a clearly visible, e.g. red, cord-like beam. With a suitable target, it is possible to locate a terrain point by means of the laser beam. Such targets are available in different forms, but require as a rule that the laser transmitter be arranged behind the viewer. In some cases, however, (e.g. in narrow outer ditches), this is not possible, or is possible only with expensive auxiliary devices, because the excavator substantially fills the available free space. In addition, a helper must be available to indicate to the excavator operator the parts of the ditch floor to be corrected. This solution is unsatifactory, apart from the required personnel, because reworking of the digging floor does not lead to the required accuracy of the ditch floor, as is necessary, for example, in the laying of large pipes.

SUMMARY OF THE INVENTION

The present invention is to permit checking of the digging device independent of the standing plane of the excavator, which offers the excavator operator the possibility of guiding the bucket along a given direction with greater accuracy.

The excavator of the present invention includes a prospecting device with a bucket mounted at its outer end. The prospecting device and bucket are mounted so as to maintain a given cutting angle. An indicator is arranged in the field of view of the excavator operator to permit the excavator operator to check the position of the digging device relative to the digging floor being formed.

In the present invention, the indicator includes a laser transmitter for producing a laser beam, and an at least partially transparent target. The transparent target is secured on the digging device and has a first surface facing the excavator operator and a second surface which receives and marks the end point of the laser beam. The laser transmitter is arranged in front of the second surface of the target and, therefore, in front of the excavator.

By setting the laser beam in the given horizontal and vertical azimuth aspects, we determine the direction in which the bucket must be guided during the digging in order to obtain the desired inclination and direction of the ditch floor. This direction is maintained by the excavator operator himself, because he can observe the position of the end point of the laser beam parallax-free, during the entire digging operation, due to the transparency of the target. The beam emitted by the laser transmitter arranged in front of the excavator, however, is not observed. Since the laser transmitter can be installed in the part of the ditch that has already been worked on, its position has to be changed less frequently than if it were installed behind the excavator operator. In addition, this position of the laser transmitter ensures that the excavator does not interfere with the emission of the laser beam by the laser transmitter.

The invention has the advantage that it permits a sufficiently accurate control of the bucket, without the standing plane of the excavator entering into the measurement. This influences only the position of the cutting edge of the bucket relative to the outline of the ditch or of the slope, which the excavator operator can maintain, however, without auxiliary means. For this reason the bucket can also be provided with control cylinders swinging about a longitudinal axis without impairing the accuracy of the digging floor. This makes it possible to excavate larger ditch cross sections in successive digging operation with the required accuracy.

Preferably and according to another feature of the invention, the target is arranged on the rear edge of the bucket associated with the dipper arm of the excavator. When the excavator changes its standing plane, and particularly when the bucket is shifted about a longitudinal axis with a device of the above-described type, the target is turned correspondingly in its plane. But this does not affect the maintenance of the given vertical and horizontal aspects, as long as the target is so aligned that its plane is substantially perpendicular to the digging movement and to the bucket edge.

In another embodiment of the invention, however, the target is arranged on the digging device of the excavator, for example, on the bucket arm, if the arrangement of the target on the bucket would have the effect that the target would move during the digging completely or partly out of the field of view of the excavator operator.

According to another feature of the invention, the target has a sighting device of concentric circles, because it was found that the excavator operator can keep the point of impact of the laser beam with such a sighting device very accurately in the center of the circle, even from great distances.

DETAILED DESCRIPTION OF THE PREFERRED EMBODIMENTS

Figure 1:
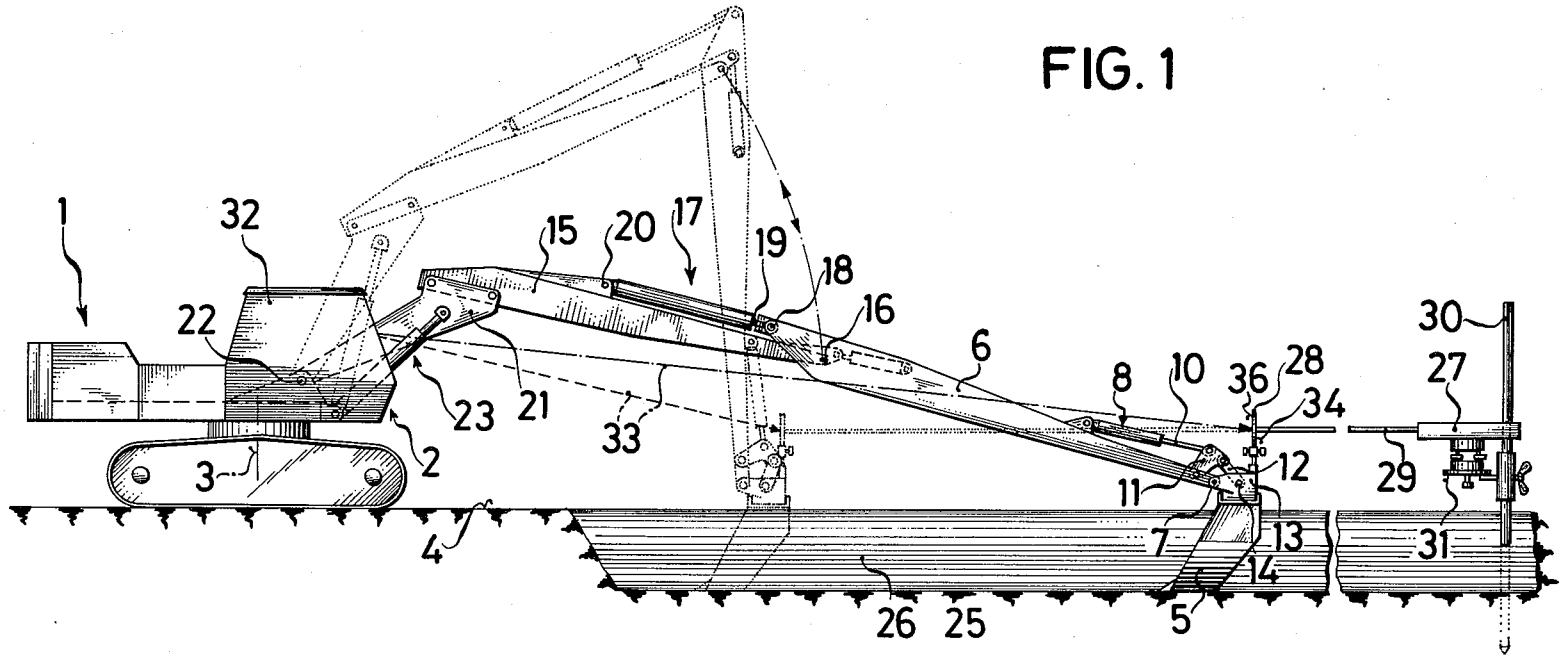
FIG. 1 shows schematically in a side elevation an excavator with the above-described arrangement representing different phases of the digging movement in solid and broken lines.

A excavator 1 with a caterpillar-type chassis has a superstructure 2 attached on the chassis over a swivel joint 3 and stands on a ground surface 4, which can be, e.g. the floor of an outer ditch. In this embodiment, however, the terrain surface has been assumed as the ground surface. Bucket 5 of excavator 1 is designed as a deep digging bucket, and can be turned at the end of dipper arm 6 with a lateral axle 7 by means of a hydraulic cylinder-piston arrangement 8. Piston rod 10 acts on a triangular shift level 11, which in turn is articulated at 14 over a guide rod 12 in the range of the rear or trailing edge 13 of the bucket facing dipper arm 6.

Bucket arm 6 is articulated to boom 15 with its pivot 16. The dipper arm 6 can be turned by means of a rear hydraulic thrust piston drive 17. This drive 17 has a piston rod 19, which is articulated in a joint 18 to the rear end of dipper arm 6. The cylinder of the thrust piston 17 is secured in a joint 20 of boom 15.

The rear part 21 of boom 15 (i.e. the part of boom 15 closest to superstructure 2) is articulated to a joint 22 on superstructure 2 of excavator 1. Boom 15 is actuated with a third hydraulic piston drive 23. Shift lever 11 is so joined with bucket 5 over short guide rod 12 that dipper arm 6, shift lever 11, and hydraulic cylinder 8 together with the front end of boom 15 form a large four-bar linkage. This four-bar linkage is coupled over a shift triangle, formed by triangular shift lever 11, with a small four-bar linkage formed of shift lever 11, the end of dipper arm 6, bucket 5, and short guide rod 12.

With a given length of boom 15 and a given length of dipper arm 6, the dimensions of the four-bar linkages, as well as the shift lever 11 are so tuned to each other, and the large four-bar linkage is so changed during the adjustment of the cutting angle of bucket 5 to the inclination of floor 25 of ditch 26, and thus so adapted to the inclination of the floor 25 that bucket 5 is guided parallel along ditch floor 25 substantially over the entire swing range of bucket 5 during the digging movements, taking into account the swinging movements of boom 15 corresponding to the inclination of the floor.

The foregoing considerations naturally also apply to ditch floors 25 which must be driven horizontally.

The excavator 1 has furthermore a checking device which is formed principally of a laser transmitter 27 and a target 28 which reproduces the end point of the laser beam shown at 29. The laser transmitter 27 is mounted on a stand 30 over a mount 31 which permits setting of the laser transmitter into the vertical and horizontal aspects of ditch 26, which are formed with laser beam 29.

The target 28 is secured according to the represented embodiment on the rear edge 13 facing the digging device of the excavator and is designed as a transparent disk. It is thus in the field of view of the excavator operator sitting in cab 32, who can consequently observe the disk over beam 33 shown in broken lines, with the digging device stretched. This beam 33 extends along the broken line when the digging device assumes its position, shown likewise in broken lines. It is also in the field of view of the excavator operator at all intermediate positions, and he can therefore control the digging movement so that the light spot reproduced by the laser beam 29 on the front surface 34 of disk 27 can be observed through the disk.

Figure 2:
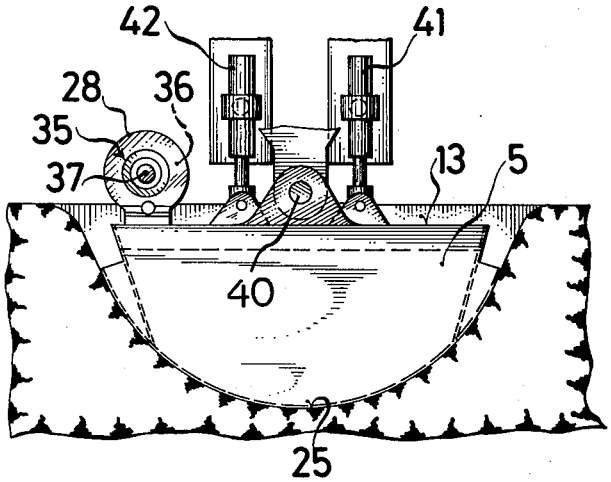
FIG. 2 shows a front view of the subject of FIG. 1 in a broken-off view.

As it can be seen particularly from the representation of FIG. 2, disk 28 is provided with a sighting device 35 which can be arranged on the rear surface 36 of the target disk 28 facing the excavator operator. But since the disk is transparent, sighting device 35 can also be arranged on the front surface 34 which reproduces the laser beam 29. The sighting device 35 consists of concentric circles, and the light spot reproduced by the laser beam 29 is assumed at 37.

The target disk 28 is so arranged that its plane extends perpendicularly to the digging direction, that is, to the movement which bucket 5 performs relative to the above-described parts of the digging device.

Laser transmitter 27 is arranged in front of the front surface 34 of disk 28. Rear surface 36 of target 28 facing the excavator operator serves as an indicator, which permits the operator to control bucket 5 so that light spot 37 of laser beam 29 remains in the center of sighting device 35.

Figure 3:
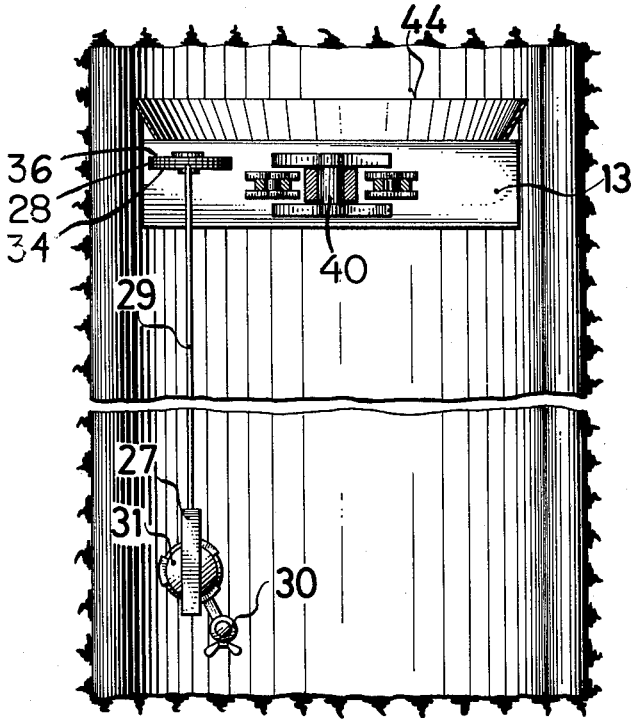
FIG. 3 shows likewise in a broken-off view a top view of the subject of FIG. 1.

In the represented embodiment illustrated in FIGS. 2 and 3, bucket 5 can be turned about a geometric axis 40, which extends in a plane with the above-described digging device. To this end two additional thrust-piston drives 41, 42 are provided, which are secured with their piston rods on edge 13 of bucket 5 facing the digging device.

The front or cutting edge 44 of bucket 5 is semicircular, so that ditch floor 25, which is curved corresponding to the cutting edge 44, can be produced in one or more digging operations, due to the exact parallel guidance of bucket 5 and the control of bucket 5 ensured by the above-described checking device.

What is claimed is:

1. In a back hoe excavator of a type having an articulated digging device with a digging bucket mounted at an outer end, in which the digging bucket is capable of being set to a given cutting angle, and in which the digging bucket is moved toward a human operator of the excavator in a digging direction during a digging operation while the digging bucket is maintained at the given cutting angle, a position indicator apparatus for checking position of the digging device of the excavator relative to a digging floor which has already been formed, the position indicator apparatus being arranged in a field of view of the human operator of the excavator to provide a visual indication of the position of the digging device to the operator, the position indicator apparatus comprising:

laser transmitter means for providing a laser beam in a direction parallel to the digging direction, the laser transmitter means being positioned on an opposite side of the digging bucket from the operator, so that the digging bucket moves in the digging direction toward the operator and away from the laser transmitter means during a digging operation;

mounting means for mounting the laser transmitter means with respect to the digging floor which has already been formed so that the laser beam is representative of vertical and horizontal aspects of a digging floor to be dug by the excavator; and target means mounted to and carried by the digging device, the target means being at least partially transparent, and having a first surface facing the operator and a second, opposite surface for receiving the laser beam from the laser transmitter, and wherein the target means reproduces a visual image of an end point of the laser beam for parallax-free observation by the operator during an entire digging operation in which the digging bucket is set to a given cutting angle and moved in the digging direction toward the operator.

2. The invention of claim 1 wherein the target means is mounted on a rear edge of the bucket.

3. The invention of claim 1 or 2 wherein the first and second surfaces of the target means are substantially parallel, and are arranged in a plane substantially perpendicular to the digging direction.

4. The invention of claim 1 or 2 wherein the target means includes a marking device consisting of concentric circles.

5. The invention of claim 1 or 2 wherein the target means is a transparent disk.

* * * * *